United States Patent [19]
Braton et al.
[11] 3,934,379
[45] Jan. 27, 1976

[54] REMOVAL OF BUILT UP LAYERS OF ORGANIC COATINGS

[75] Inventors: Norman R. Braton; Jan R. Acker, both of Madison, Wis.

[73] Assignee: Wisconsin Alumni Research Foundation, Madison, Wis.

[22] Filed: Sept. 3, 1974

[21] Appl. No.: 502,900

[52] U.S. Cl. ..... 51/319; 51/322; 241/18
[51] Int. Cl.[2] ..... B24C 1/00
[58] Field of Search ..... 51/314, 317–322; 241/18, 23, 65, DIG. 13; 134/38

[56] References Cited

UNITED STATES PATENTS

| | | | |
|---|---|---|---|
| 1,978,204 | 10/1934 | Hurt | 241/DIG. 13 |
| 2,234,157 | 3/1941 | Jones | 241/DIG. 13 |
| 2,996,846 | 8/1961 | Leliaert | 51/322 X |
| 3,192,677 | 7/1965 | Johnson | 51/14 X |
| 3,824,739 | 7/1974 | Moret | 51/322 X |

*Primary Examiner*—Donald G. Kelly
*Attorney, Agent, or Firm*—McDougall, Hersh & Scott

[57] ABSTRACT

A method for removal of layers of organic material built up on a support for articles during surface coating and treating comprising applying a liquefied inert gas to the support and/or preferably to the built up layers of organic material to cause embrittlement of the organic material and lessening of the bonded relation between the support and the built up layers, and then separating the embrittled built up layers from the support by abrasion of impact.

13 Claims, No Drawings

REMOVAL OF BUILT UP LAYERS OF ORGANIC COATINGS

This invention relates to the removal of layers of organic coatings built up upon the surfaces of carriers or supports and relates more particularly to the recovery of carriers or supports by the removal of undesirable deposits which progressively built up on the surfaces thereof.

In many industrial processes it is desirable to apply one or more surface finishes or surface treatments to parts. Such surface finishes, such as base coatings or finished color coatings, and many surface treating compositions contain organic binder components to effect adherence of such coatings or finishing compositions to the surfaces of the parts being coated or treated. When the parts are being coated or treated by a spray process or electrostatic coating process, the part is usually supported on a pedestal during exposure to the spray coating or electrostatic coating operation. When the parts are coated or treated by a dip coat, flow coat, spray coat or electrostatic coating process, it is the usual process to suspend such parts from a hanger rod during exposure to such coating or treating operations.

It is impractical to mask the parts in a manner to restrict the coating or treating compositions to the portions being coated or treated. As a result some portion of the coating composition or treating compositon finds its way onto the support or hanger rod by which the article is supported during exposure to the coating or treating material.

Such support or suspending device is used repeatedly for such operation with the result that the coating or treating composition builds up on the support or hanger rod. Oftentimes the support rod continues to support the article during a subsequent processing beyond the coating or treating step, such as through a baking step wherein the coating article is subjected to a drying and heating cycle for setting or cooling the applied coating. Such heating step serves to bake and re-bake the coating or treating materials that build up on the article support.

Soon the material built up on the support renders the support incapable of use in the absence of the removal of the cake of material built up on the surfaces above. The removal is rendered difficult by reason of the presence of the organic binder which operates to interbond the built up layers one onto the other and to the surfaces of the support. Removal is rendered even more difficult where the organic binder is heat sensitive and the supports have been subjected to repeated heating cycles during support of the coated or treated article through a baking or cooling operation.

The problem arises most frequently in continuous operations for color coating to produce finished parts wherein use is made of an endless chain from which hanger rods are suspended in longitudinally spaced relation. The chain winds its way through a mounting station wherein the articles are hooked onto the rods, a coating station wherein the coating composition is applied, as by spray coating, dip coating, flow coating, electrostatic coating and the like, a drying zone wherein the coating is allowed to dry in whole or in part, a baking zone wherein the coated articles are carried through a drying or baking oven maintained at elevated temperature, and unloading station wherein the coated articles are removed from the hanger rod, and returned to the loading zone where the travel through the cycle of operations is repeated.

The problem of removal is further complicated by the fact that, from time to time, the composite built up on the support may differ from layer to layer through the cross section by reason of the use of the support for articles treated or color coated with compositions that differ one from the other.

Others have sought to effect removal of such built up composites from the surfaces of the supports by emergence of supports in a liquid medium such as a solvent, with a view towards dissolving the material off the support, or chemicals such as an alkali which attacks the binder component with the intent of bringing about the decomposition thereof.

Such techniques are faced with a number of objections: the solvents or chemicals are not only relatively expensive but considerable care must be exercised in their handling and use because of their combustibility, the corrosive nature of the chemicals and the fumes that are given off. Considerable amount of equipment and energy is required and oftentimes long periods of soaking are necessary to effect sufficient alteration of the materials of the composite to enable removal. This not only requires the expenditure of considerable labor for handling, but the residual liquids and solids present serious problems of disposal. In general, the entire recovery procedure is unattractive from the standpoint of the messy materials that are left for disposal.

Another technique that has been tried makes use of oxidative combustion of the organic matter by heating the entire assembly in a combustion furnace in which an oxidizing atmosphere is maintained. This technique is limited in its practice to supports formed of non-combustible material such as steel or iron. A considerable amount of heat is required to raise the temperature of the entire assembly, including the metal support as well as the composite to combustion temperature, thereby to materially increase the cost of recovery.

Such combustion procedures are relatively slow and a considerable amount of time is consumed in loading and unloading the furnace and heating up to combustion temperature and special equipment is required for such purposes. Aside from the above, the supports are sometimes undesirably altered by the temperature conditions at which they are exposed and oftentimes an undesirable residue is left on the support which becomes even more difficult to remove.

Thus it is an object of this invention to provide a simple and efficient method for the removal of organic deposits built up on the type of supports described; in which the deposits can be cleanly removed from the supports in a manner which raises no problem of material handling or disposal of the composite material after separation of the support; which is capable of use without special handling and with a minimum amount of labor, or additional space or equipment; which can be carried out without the need for removal of the supports from their normal arrangement in use; which can be adapted to a continuous operation as an adjunct to the in-line operation of the supports during their normal use in coating or treating the surfaces of articles; in which the removal of the built up composites is rapid and complete thereby to leave a clean support for subsequent reuse, and in which the process is capable of being practiced with wooden or the like supports, fabricated of natural or synthetic materials as well as material supports thereby to enable multiple use of the process of this invention.

Briefly described, the concepts of this invention reside in the lessening of the bonded relationship at the interface between the composite and surface of the support whereby clean separation of one from the other can be effected. This, coupled preferably with the embrittlement of the composite interface, enables removal of the organic composite to be effected in response to simple impact or abrasion or a combination of both for a separation of the composite as a solid material.

The lessening of the bonding relationship between the composite of the organic material and the surfaces of support relies on their differences in coefficients of thermal expansion and contraction whereby a sudden change in temperature of one or the other or both will bring about differences in the amount of expansion or contraction thereby to strain the bonded relationship between the composite and the support at their interface.

In accordance with the preferred practice of this invention, the desired temperature differential is effected by a sudden reduction in the temperature of the support or the composite or both, but it is preferred to effect rapid cool-down of the material making up the composite to effect embrittlement of the composite simultaneously with the lessening of the bonding relationship between the composite and the support at their interface.

As the coolant for rapid reduction in temperature, use should be made of a liquid, preferably a liquefied gas having a boiling point below −60°F. at atmospheric pressure and preferably liquefied gas, such as liquefied air, liquefied nitrogen or carbon dioxide. Each of these is available in unlimited amounts and at a relatively low cost, some as for a by-product for recycling gaseous materials such as liquid oxygen which finds major use in the oxygen converter process used in the manufacture of steel. The gaseous products that are given off in response to the utilization of such liquefied gas as coolants are inert gases which can be freely fielded off into the atmosphere.

The desired rapid temperature change can be effected in a number of ways. When the support is formed of a material which is highly heat conducted, the support can be immersed in whole or in part in a bath of the liquefied gas. For example, portions of the rod or support can be dipped into the bath of liquefied gas whereby the end portion will be rapidly reduced in temperature. Such reduction in temperature transfers by conduction through the rod or support to the portions underlying the composite coatings to effect reduction in the bonded relationship and at least partial embrittlement. Such whole or partial immersion of the support in the bath of liquefied gas can be done piece by piece or the entire process can be carried out as a continuous operation by providing a bath in a line having a drop portion for dipping the supports into the bath.

It is preferred to effect the desired temperature change by application of the liquefied gas directly onto the composite coating. This can be achieved by a flow coat process or by a dip coat process, but it is preferred to effect application by a spray process wherein the liquefied gas is sprayed directly onto the surface of the composite coating to effect rapid refrigeration thereof as the liquefied gas evaporates from the wetted surfaces. This not only effects the desired embrittlement of the material making up the composite layer, but a saving is experienced in the amount of liquefied gas that is used since the cooling down of the metal base or support is not required. Such application by spray coating does not require a facility to collect the overflow or excess since the amount sprayed onto the surface can be controlled to that which is fully converted to the gaseous state and for effecting the desired amount of refrigeration.

Application by spray coating or flow coating can be effected while the support is suspended or otherwise supported on a base. However, the process of spray or flow coating the surfaces of the composite layers built up on the supports enables application of the liquefied gas without removal of the supports from their normal arrangement and position of use on the endless chain or conveyer. The supports or hanger rods can be sprayed or otherwise wetted with the liquefied gas as they advance through an application zone to effect the rapid refrigeration of the composite layer. The amount of time for refrigeration will depend upon the temperature of the liquefied gas, the manner of application as well as the thickness of the composite layer. For layers greater than ¼ inch thickness, the application of liquid nitrogen for 24 seconds would be sufficient to effect the desired rapid refrigeration.

Removal of the composite layer, after refrigeration, can also be carried out in a number of ways. In the event that removal is being made of composite material from the surfaces of the hanger rod or support, clean removal can be effected by means of a blast of abrasive material directed onto the composite layer immediately following refrigeration. Such abrasive particles can be blasted onto the surfaces by means of an air blast, using a conventional air gun or by means of an airless blast using a centrifugal wheel by which means abrasive particles such as sand or metal shot are drawn radially outwardly at a high speed from radially extending blades mounted in a rotating wheel. Such airless centrifugal blasting means are well known to those skilled in the art such as "Wheelabrators" manufactured by Wheelabrator-Frye Inc. of Mishawaka, Indiana.

In the event that the composite layer is of a thickness too great for efficient removal by abrasive particles blasted onto the surface, removal can be effected by impact after refrigeration by an amount to cause embrittlement of the organic materials making up the composite layers. Such impact can be effected by means of a hammer or other tool which, because of the brittle character of the composite, will shock the material to cause breakup into small pieces which fall from the support. Impact, such as by means of a hammer, can be applied to the rodder support or directly onto the composite layers if necessary. Oftentimes a combination of impact will be sufficient to effect clean removal of the built-up layers for return of the hanger rod on support substantially to its original condition.

The blasting or impacting, to effect removal, can be carried out as a continous operation with the previous step of refrigeration, or it can be carried out as an intermittent operation on each piece as it is refrigerated. In any event, such impacting or blasting should be effected immediately following refrigeration or during the last stages of refrigeration so that the composite material will be in the refrigerated state during such removal operation. The removed composite material falls gravitationally from support and can be collected in suitable pans or hoppers for dispersal. With thin layers, it is sufficient to freeze to effect unbonding of the layer to removal by blasting, with thicker layers it is preferred to freeze to effect unbonding and to embrittle to removal by impact.

We claim:

1. In the method for removing layers of organic material built up on a support for articles during surface finishing or treatment thereof, the steps of rapidly reducing the temperature of at least one of the elements including the built up layers and the support to lessen the bonded relation between the built up layers and support, and then impacting the built up layers while the built up layers are still in the refrigerated state.

2. The method as claimed in claim 1 in which, when the built up layers are of relatively thin cross-section, impacting of the built up layers is effected by blasting the built up layers with a particulate material.

3. The method as claimed in claim 2 in which impacting is effected by throwing dry particulate abrasive at high velocity onto the built up layers.

4. The method as claimed in claim 1 in which the step of rapidly reducing the temperature comprises immersing the support with the built up layers, in whole or in part, into a bath of liquefied gas.

5. The method as claimed in claim 4 in which the liquefied gas has a boiling point of less than −60°F at atmospheric pressure.

6. The method as claimed in claim 1 in which the step of rapidly reducing the temperature comprises reducing the temperature of the built up layers by wetting the surfaces of the built up layers with a low boiling liquefied gas.

7. The method as claimed in claim 6 in which the liquefied gas has a boiling point temperature at atmospheric pressure of less than −60°F.

8. The method as claimed in claim 6 in which the liquefied gas is an inert gas selected from the group consisting of air, nitrogen and carbon dioxide.

9. The method as claimed in claim 6 in which the built up layers are refrigerated by spraying the liquefied gas onto the built up layers and support.

10. The method as claimed in claim 6 in which the built up layers are refrigerated by flow coating the built up layers with the liquefied gas.

11. The method as claimed in claim 6 in which the built up layers are refrigerated by dip coating the built up layers in a bath of liquefied gas.

12. The method as claimed in claim 6 in which the impacting is effected by impact of the support.

13. The method as claimed in claim 1 in which refrigeration and impacting of the built up layers are carried out as a continuous operation in direct sequence with the impacting following immediately after refrigeration.

* * * * *